US007743779B2

(12) United States Patent
Gee, Sr.

(10) Patent No.: US 7,743,779 B2
(45) Date of Patent: Jun. 29, 2010

(54) CRUTCH STROLLER

(76) Inventor: Larry Ellis Gee, Sr., 10147 S. Wallace St., Chicago, IL (US) 60628-1841

( * ) Notice: Subject to any disclaimer, the term of this patent is extended or adjusted under 35 U.S.C. 154(b) by 0 days.

(21) Appl. No.: 12/015,094

(22) Filed: Jan. 16, 2008

(65) Prior Publication Data

US 2008/0174084 A1 Jul. 24, 2008

Related U.S. Application Data

(60) Provisional application No. 60/885,813, filed on Jan. 19, 2007.

(51) Int. Cl.
*A61H 3/04* (2006.01)

(52) U.S. Cl. ..... 135/67; 135/66; 135/85; 280/87.021; 482/67

(58) Field of Classification Search ..... 135/66–68, 135/69, 71, 85; 482/66–69; 280/87.021, 280/47.34; 297/5–6; 188/167
See application file for complete search history.

(56) References Cited

U.S. PATENT DOCUMENTS

| | | | | |
|---|---|---|---|---|
| 130,283 | A | 8/1872 | Darrach | |
| 1,307,058 | A | 6/1919 | McGrath | |
| 2,847,057 | A * | 8/1958 | Holcombe | 482/68 |
| 3,195,550 | A | 7/1965 | Ingalls | |
| 4,159,110 | A * | 6/1979 | Dodenhoff | 482/68 |
| 4,226,413 | A | 10/1980 | Daugherty | |
| 4,251,105 | A | 2/1981 | Barker | |
| 6,003,532 | A * | 12/1999 | Pi | 135/67 |
| 6,070,603 | A * | 6/2000 | Politz | 135/67 |
| 6,296,263 | B1 * | 10/2001 | Schultz et al. | 280/87.021 |
| 2001/0048206 | A1 | 12/2001 | Parsell | |
| 2004/0020525 | A1 | 2/2004 | Lev | |
| 2006/0254631 | A1 | 11/2006 | Mullholand | |

FOREIGN PATENT DOCUMENTS

| | | | |
|---|---|---|---|
| JP | 08066439 | A * | 3/1996 |
| JP | 09010267 | A * | 1/1997 |
| JP | 2001353193 | A * | 12/2001 |
| WO | WO 3086264 | A1 * | 10/2003 |

* cited by examiner

*Primary Examiner*—Winnie Yip

(57) ABSTRACT

A mobility aid (FIG. 1) design for providing stabilized mobility support by the practical use of a two sided vertically supported rigid frame comprising front and rear bilaterally double support members (12), (12*a*), (13), (13*a*), (15), and (15*a*), and not limited to but preferably of aluminum construction to include a plurality of upper and lower substantially identical bilaterally horizontal and vertical tubular main frame members (17), (18), (19), (20), (22), (27), (28), and (29), supported on a plurality of sufficiently sized wheels (26), and (30), attached to the underside of the main frame (26), and (30), with predetermined spacing. Base members (22), (28), and (29), are sufficiently elevated-providing for unhindered foot movement during mobilization. A guide wheel assembly (23), (25), (25*b*), (26), and (26*a*), is vertically attached at a contiguously anterior junction surface of the two sided main frame assembly (20), and (23), thereby providing selective directional steering. Hand brake controls (16), secure by clamps to riser connectors (15), activate brakes (31).

13 Claims, 6 Drawing Sheets

CRUTCH STROLLER

CROSS-REFERENCE TO RELATED APPLICATION

This application claims the benefit of provisional patent application Ser. No. 60/885,813 filed Jan. 19, 2007 by the present inventor.

FEDERALLY SPONSORED RESEARCH

Not Applicable

SEQUENCE LISTING OR PROGRAM

Not Applicable

BACKGROUND OF THE INVENTION

1. Field of the Invention

The present invention relates to mobility aids, specifically to those used as means to combine the features of both stability and mobilized body support for an individual with manifested physical limitations and abilities that are the results of generalized weakness due to sickness, crippling bone disease, deformities, and post surgical procedures.

2. Prior Art

Mobility aids as forms of prior art were designed as a means of assisting individuals that experienced decreased leg strength or deformities; however, during the recovery process of these individuals, durable medical equipment companies most often supplied them with either the conventional hand-held walker, rolling walker, walking cane, or crutches individually, but none of those devices were capable of supplying the assistance required for the rehabilitation of weak legs when so many other areas of the body needing support was totally neglected. Originally, these devices were thought to give sufficient stability and support; however, since an adequate sense of balance, strength in the arms, legs, wrists and back areas are also required to operate these devices, the individual using these devices would soon become exhausted and limit their activities of exercise resulting in prolonged rehabilitation.

A walker, as a mobility aid of prior art has stability due to the construction of the base, but since the stability feature of that walker is limited to stabilizing the walker and not the individual user, it is not sufficiently accommodating alone to provide adequate assistance in the mobilization of an individual, whereby the resulting effects generally produced significant postural and back problems or injury due to the lack of proper body alignment and support.

Crutches, have a definite advantage over a walker, because they provide more contact points between the device and the individual user, wherein means to relieve stress from the back areas and weight off the legs is provided. But crutches alone hinder the endurance of the weak, because most of the individuals energy is used lifting the crutches with each step taken.

An apparatus combining both the stability of a walker and the support features of crutches, increases physical endurance by alleviating stresses, and substantially decreases limitations on independence, and improves security of safe mobility.

Dating back as far as the 1800's inventors have made several unsuccessful attempts to combine the advantages of both the walker and crutches; however, during the production of those earlier models such factors as the bulk weight, size of the device, the localized limitations on maneuverability and transportation of the device were not considered for lifestyles of today. One such invention was U.S. Pat. No. 130,283 Aug. 6, 1872 to S. A. Darrach of Orange, N.J., which was too large to easily transport by any vehicle, not conveniently maneuverable in a privately owned home, and the usage would be limited to hospitals and nursing homes.

Another invention, U.S. Pat. No. 4,226,413 Oct. 7, 1980 to Wilma J. Daugherty of Garden Grove, Calif. concentrated more concerns on a foot brake design feature, which required the user to lift one foot in order to apply the brake, whereby unsteady gait could cause falls and injury due to imbalance. Also, the single bilateral support bar member was so close to the rear of the device, that backwards falls would be the inevitable. Thus, safety was not a feature of that device.

Another mechanism U.S. Patent No. 20010048206 to Douglas Parsell of Ridgeland, Miss., Dec. 6, 2001 list claims of stability, but there is more emphasis on spring loaded pistons used to apply the brakes, that only functioned when adequate pressure on handles were-applied. If the user did not have adequate strength this device would be dangerous on declining surfaces, add work load for weakened wrists and arms.

Thereafter, U.S. patent No. 2004/0020525 A1 Feb. 5, 2004 to Harry Lev of Youngstown, Ohio created a device with small castors that would present a difficult situation during attempts to mobilize the device on carpet, ruff surfaces, and tilting over the device during maneuvers. Another danger of this device was instability, due to the hand grip placements being so far to the rear of the upper "U" shaped member, making this device unsafe to operate.

Another invention under patent No. 20060254631 to Larry Mullholand, of Santa Paula, Calif. Nov. 16, 2006 wherein it is mentioned that this device relates to a weight relieving walker; however, it states in the abstract of this device that a seat is positioned to support the pelvis of the individual user to help propel the device on a "hands free" basis, but if this is a hands free operation, how does it relieve weight?.

Whether a mobility aid is built for walking, standing or to minimize the ambulatory efforts of the individual user, safety should always be a considering factor during production and selection of a device.

Objects and advantages of the present invention are:

a) To provide an assistive mobility aid combining the stability of a walker and the support advantages of a-durable crutch assembly;

b) To provide an assistive mobility aid whose production allow for convenient folding and adjustability to accommodate easy-transport and storage;

Objects and advantages of the present invention are:

c) To provide an assistive mobility aid wherein service is dependable to post operative patients, orthopedic patients, those suffering from deformities, injuries, bone and joint disease, and especially servicemen with injuries to lower limbs.

d) To provide an assistive mobility aid wherein a superior frame is provided for greater and reinforced support members.

e) To provide an assistive mobility aid which includes underside base members which are substantially elevated to allow for unhindered foot movement and avoidance of stumbling over a low base member during mobility;

Further objects and advantages are to provide a sturdy center of gravity for body support to allow for greater safety during mobility; bilateral hand brakes providing positive direct pressure to rear wheels by a slight squeezing on hand control for application of brakes. Still further objects and advantages will become apparent from a consideration of the ensuing description and drawings.

SUMMARY

In accordance with the present invention a mobility assistance aid combining the features of both stability and support, comprising: a sturdy, rigid tubular material having sufficient durability and a predetermined center of gravity with a vertically standing two sided "V" shaped open entry frame in which an individual user stands independently with support assist, wherein selective directional steering and bilateral hand braking is controlled, whereby mobilized body support for an individual with manifested physical limitations and abilities is provided.

DRAWINGS

Figures

In the drawings, closely related figures have the same number but different alphabetical suffixes.

| | |
|---|---|
| 10 | arm pad support |
| 10a | arm pads |
| 11 | horizontal connectors |
| 12 | vertical support bar ® |
| 12a | vertical support bar (L) |
| 13 | adjustment hole |
| 13a | rear support bar |
| 14 | adjustment pins |
| 14a | adjustment holes |
| 15 | riser |
| 15a | riser connectors |
| 16 | hand brake |
| 17 | platform tower (front) |
| 18 | platform tower (rear) |
| 19 | descending member |
| 20 | ascending member |
| 21 | caster plate & bolt |
| 22 | ascending base member |
| 23 | tubular member (vertical) |
| 24 | caster bolt |
| 25 | swivel casters |
| 26 | 7½ inch guide wheel |
| 26a | front wheel axel |
| 27 | platform riser |
| 28 | base member |
| 29 | descending base |
| 30 | rear wheels |
| 31 | brakes |
| 32 | rear axel |
| 33 | brake connector |
| 34 | brake connector |
| 35 | folding bracket |
| 36 | man in open space |

DETAILED DESCRIPTION

FIGS. 1-6

Preferred Embodiment

Figure 1:
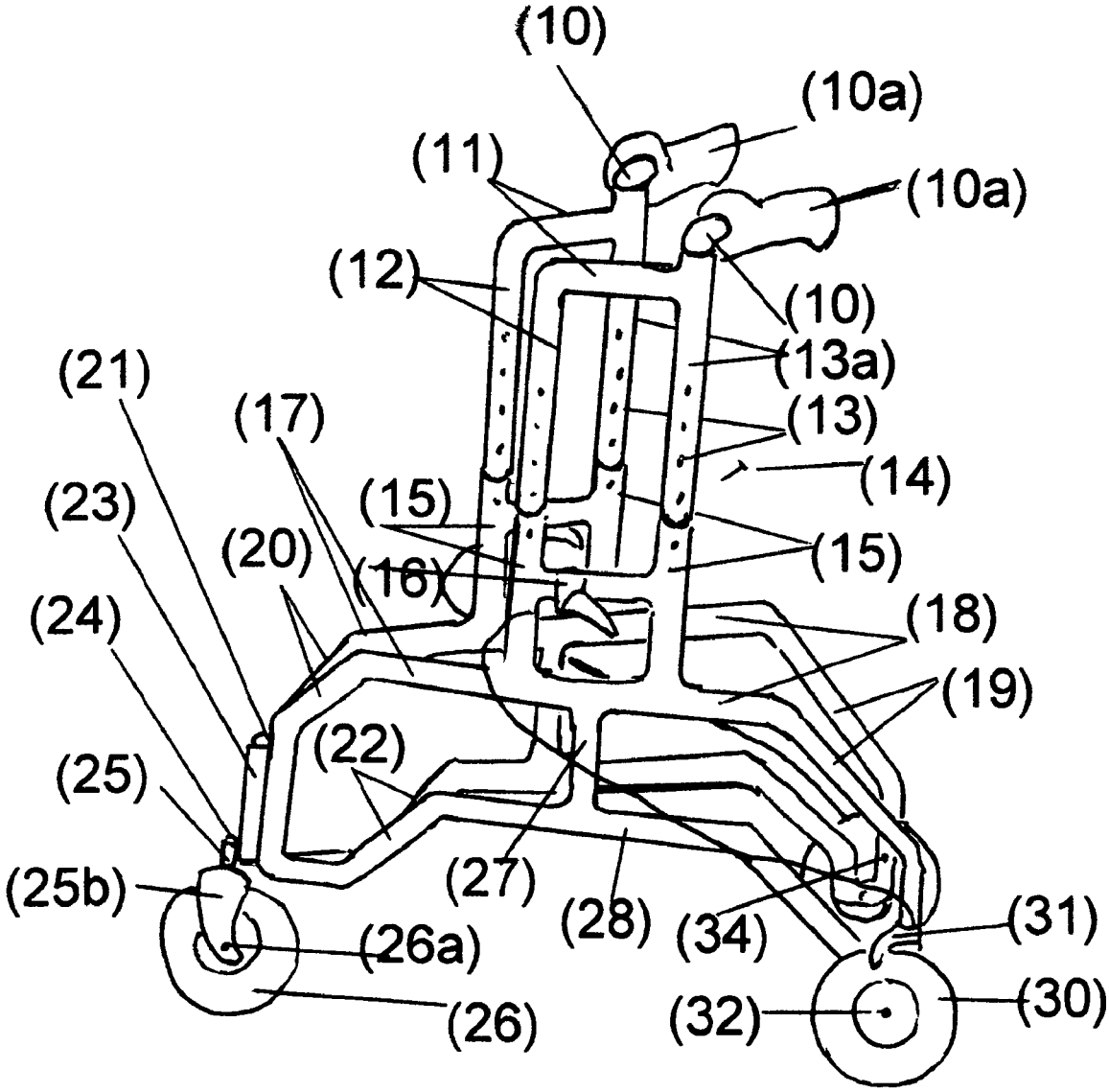
FIG. 1 shows a simplified left sided view of the crutch stroller.

FIG. 1 in the particularly advantageous embodiment of the invention the crutch stroller, as demonstrated in FIG. 1, showing a left sided view of a wheeled walker comprising a plurality of elongated cylindrical tubular members (10, 11, 12, 13, 15, 17, 18, 19, 20, 22, 27, 28, 29), of varying lengths comprising a V-shaped rear open end entry between (18, and 19), consisting of rigid material selected from a group consisting of aluminum and being weld jointed to form a two sided main frame member (17, 18, 19, 20, 22, 27, 28, 29), which comprises upper members as a horizontally paralleling front platform tower (17), a horizontally paralleling rear platform tower (18), a rear descending member (19 ), wherein open entry is provided to define a space in which the user may stand or walk, and further including a rear descending base member (29), which is designed to reinforce the wheel base and supporting feature of the rear open entry point, and a base member (28), which maintains a continuity of the horizontally paralleling base member and proceeds forward with elevation to allow for maximum space for foot movement during walking, an ascending base member (22), is continuously joined to (28), to reinforce an upper ascending member (20), while completing a union to form a vertical anterior junction (23).

Figure 2:
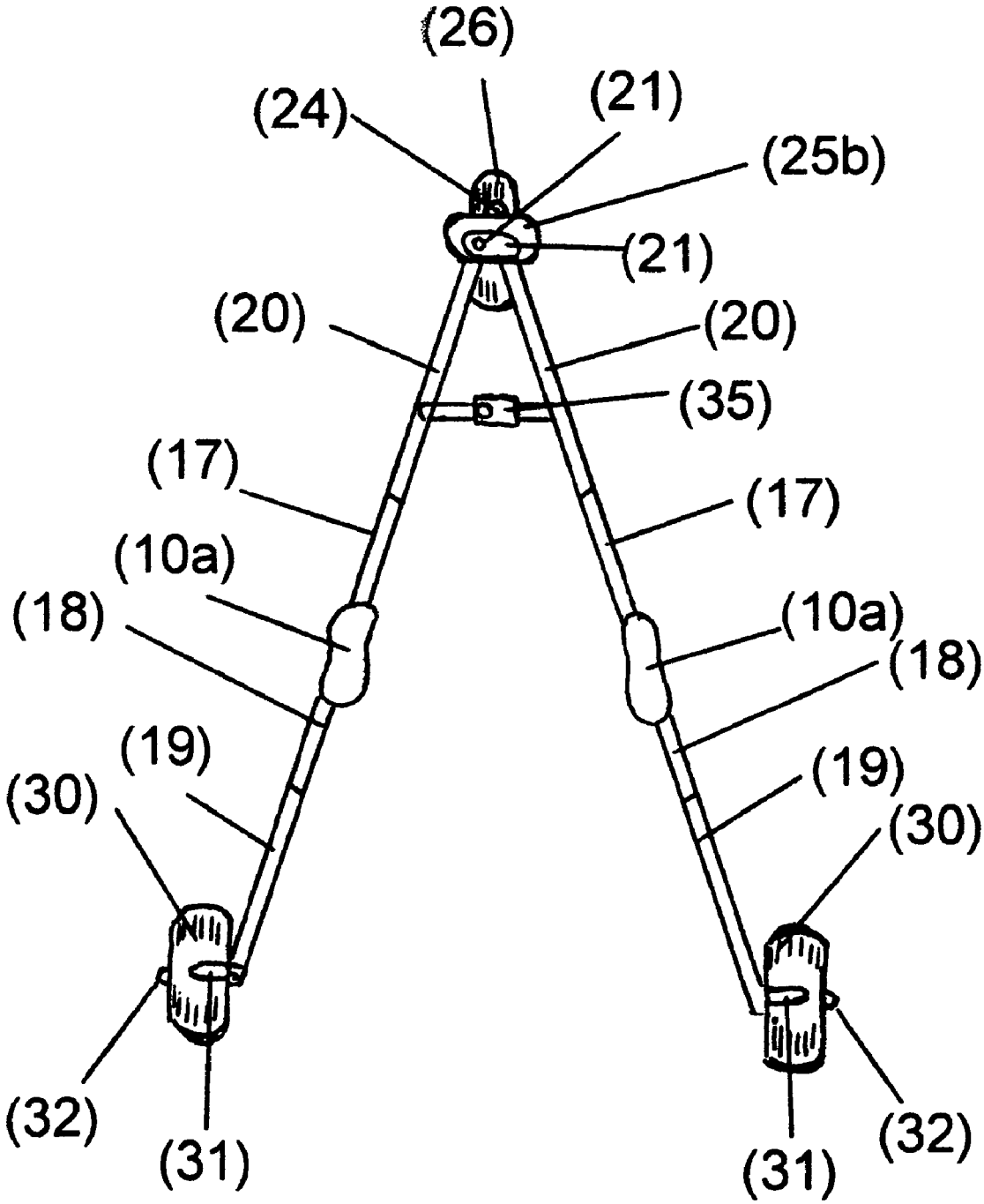
FIG. 2 shows an over-head view of the right and left sides of the "V" shaped open end entry of the main frame.
Figure 3:
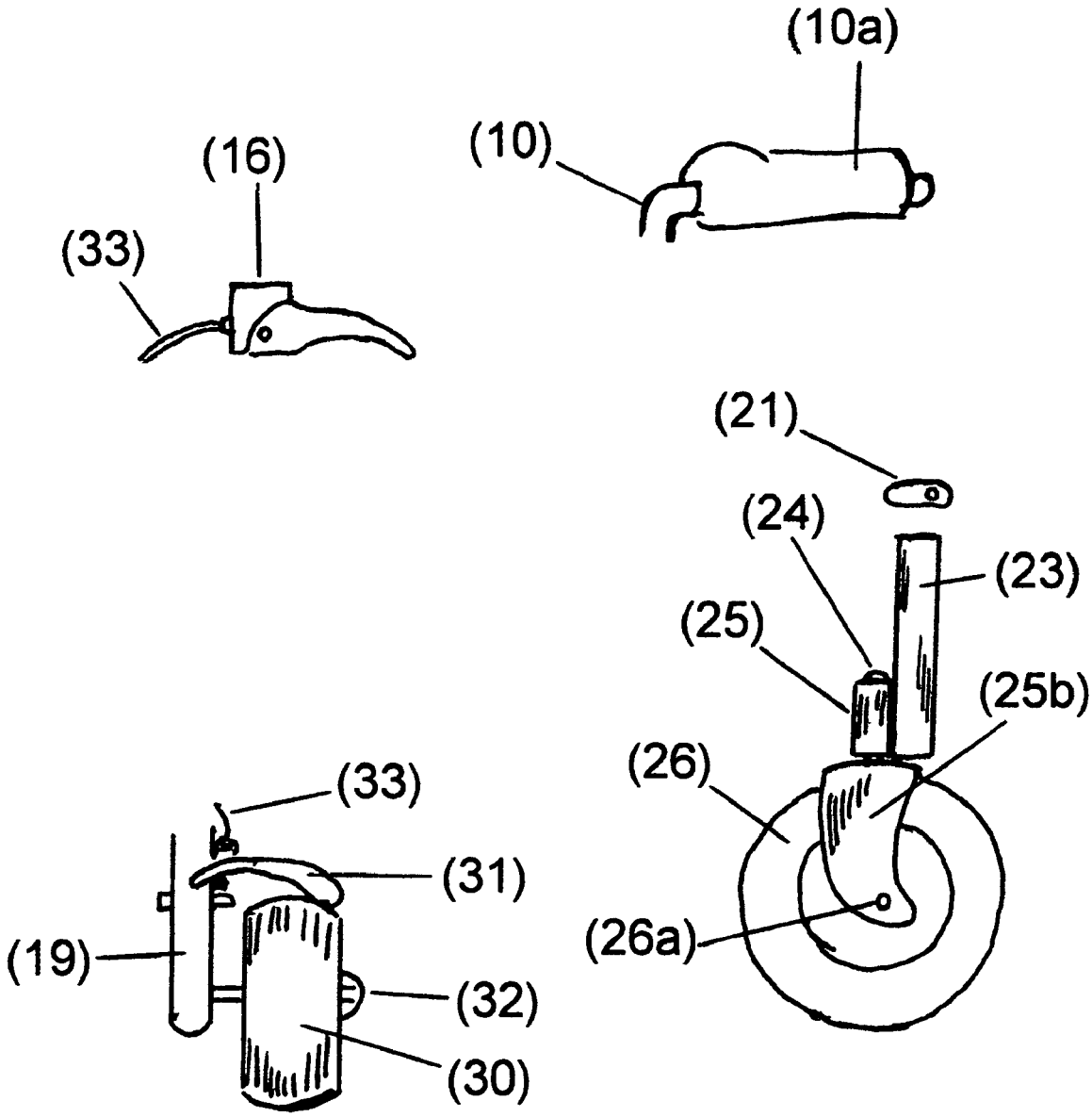
FIG. 3 shows a front guide wheel, rear wheel assembly with brake assembly, a hand brake and arm-pit pad assembly.

FIG. 1 continues as it shows a vertically reinforced crutch portion including a plurality of vertical support members (10, 10*a*, 11, 12, 13, 13*a*, 14, 15, 15*a*, 16), each-having front and rear vertical support members comprising at least a pair of telescoping interrelated front and rear members on opposite sides arranged so that at least two of each telescoping members of each pair slides within a respective lower member of each pair, and including a pair of underarm pads (10*a*), which are adhesively attached to an L-shaped tubular arm pad support members (10), and mounted on opposite sides of the upper ends of each crutch member, the L-shaped tubular pad support members (10) being joined to the upper end of each crutch member are received into a rear opening of each horizontal connector (11), which including each end of the horizontal connectors being mounted by weld joints to each corresponding upper end of each crutch member, FIG. 1 the lower crutch portion comprising risers (15), each having front and rear vertical support members mounted on the horizontally paralleling upper platform towers between (17, and 18), on each side of the main frame, each riser having a design to receive the upper crutch portion ((12, 13*a*), as a vertically sliding unit to allow for a vertical adjustment of height; the front and rear vertical support members (12, 13*a*, and 15), includes a horizontal riser connector(15*a*), which is designed to enhance and reinforce the crutch members and provide a hand grip portion, which includes a horizontally mounted hand brake mechanism, comprising a brake lever (16) with cable attachment to at least one rear wheel engaging element (31), mounted on each side frame in braking relationship to each rear wheel (30), and each rear wheel being disposed on rear axels; a front axel (26*a*), comprising a lead guide wheel mounted thereon, includes a swivel caster assembly (25*b*), defining a space in which the lead guide is disposed for change of direction of the walker, FIG. 2 is an overhead perspective view the crutch stroller showing a plurality of elongated cylindrical "V" shaped tubular members of varying lengths including a two sided, horizontally paralleling upper main frame portion, consisting of an ascending upper member (20), converging bilaterally from a contiguously jointed anterior junction, wherein a pivotal connection to bilaterally reinforcing vertical support members (23), are provided, and further including a rear platform tower on opposite sides of the main frame, a horizontal folding bracket is revealed mounted to the forward end of the front platform tower (17), each end of the horizontal folding bracket is attached on opposite sides of the front platform towers, underarm pads (10*a*), reveal a connection on the upper ends of each crutch member; a rear platform member (18), of the horizontally paralleling upper main frame member is shown to connect to the descending member (19), of the upper main frame, upon which the rear axels (32), maintain a lateral end arrangement, whereby rear wheels (30), are mounted thereon, the distal end of the descending member (19), reveals a wheel engaging element (31), FIG. 3 demonstrates a side view of a brake lever (16); and a cable connection (31), whereby a wheel engaging element may be operated, item (10) shows a side view of an "L" shaped tubular member, whereby an underarm pad may be attached, and further included in FIG. 3, is a side view of a swivel caster assembly including a bilateral vertical member (23), whereby attachment of each side of the vertical member (23), to a corresponding side of the anterior junction of each side of the main frame maintain a connection in order to be foldable towards each other, and mounted on top of the bilateral vertical members (23), is a caster plate and bolt (21), designed to secure the bilateral vertical members, one side to the other; the swivel caster assembly further includes a swivel caster (25), with a hollow center, which is designed to receive a pivot bolt (24), to allow for pivotal movement of the front guide wheel from left to right direction change, a vertically arranged bilateral fork (25*b*), defines a space in which the front guide wheel (26), and axel (26*a*), are interconnecting, FIG. 3 continues as it displays a rear view of the descending tubular member (19), upon which at least on brake cable connector (33), one wheel engaging element (31), and one rear wheel axel (32), are connected with a rear wheel (30), connected thereon.

Figure 4:
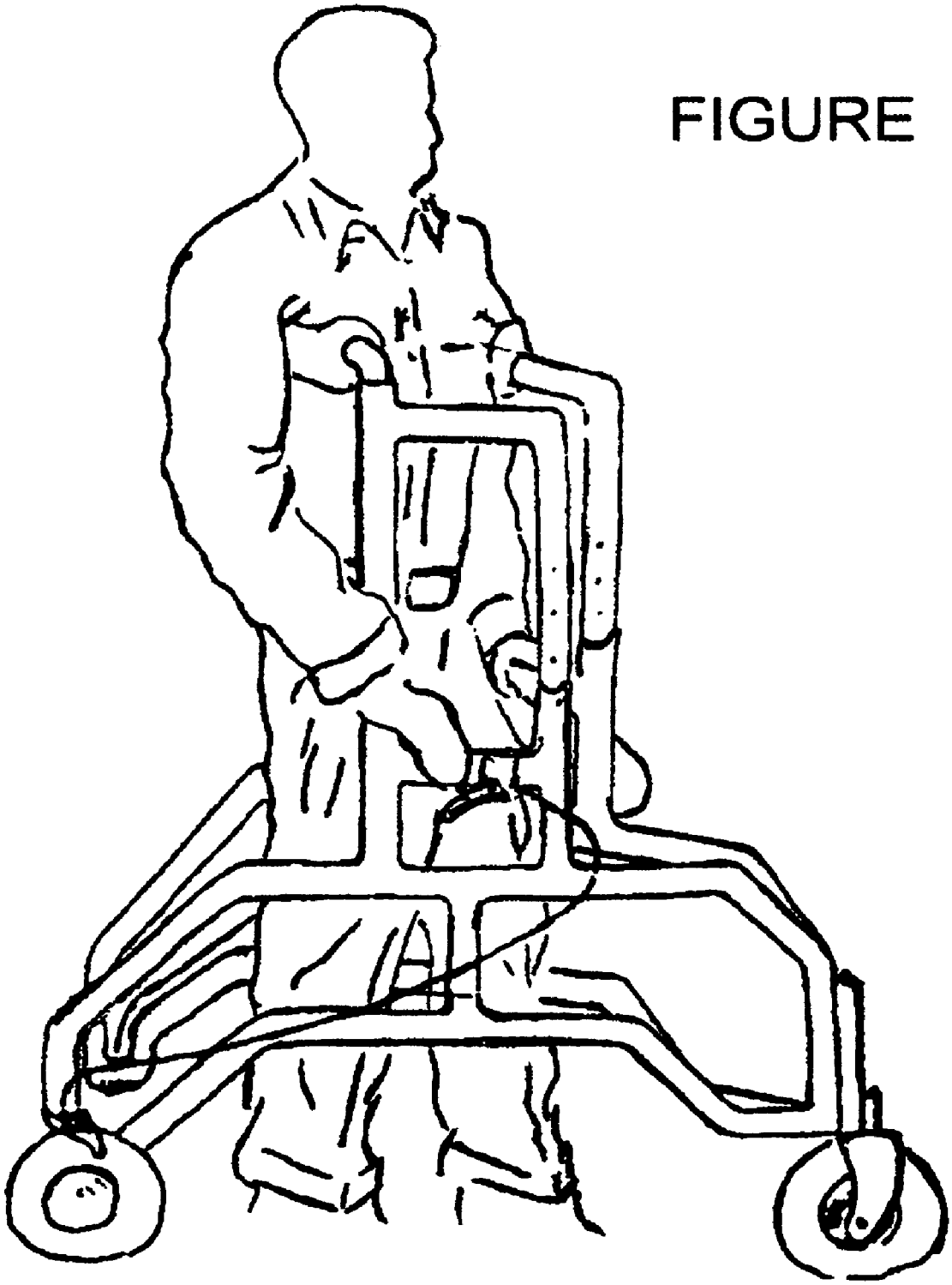
FIG. 4 shows an individual standing within the "V" shaped open entry frame.
Figure 5:
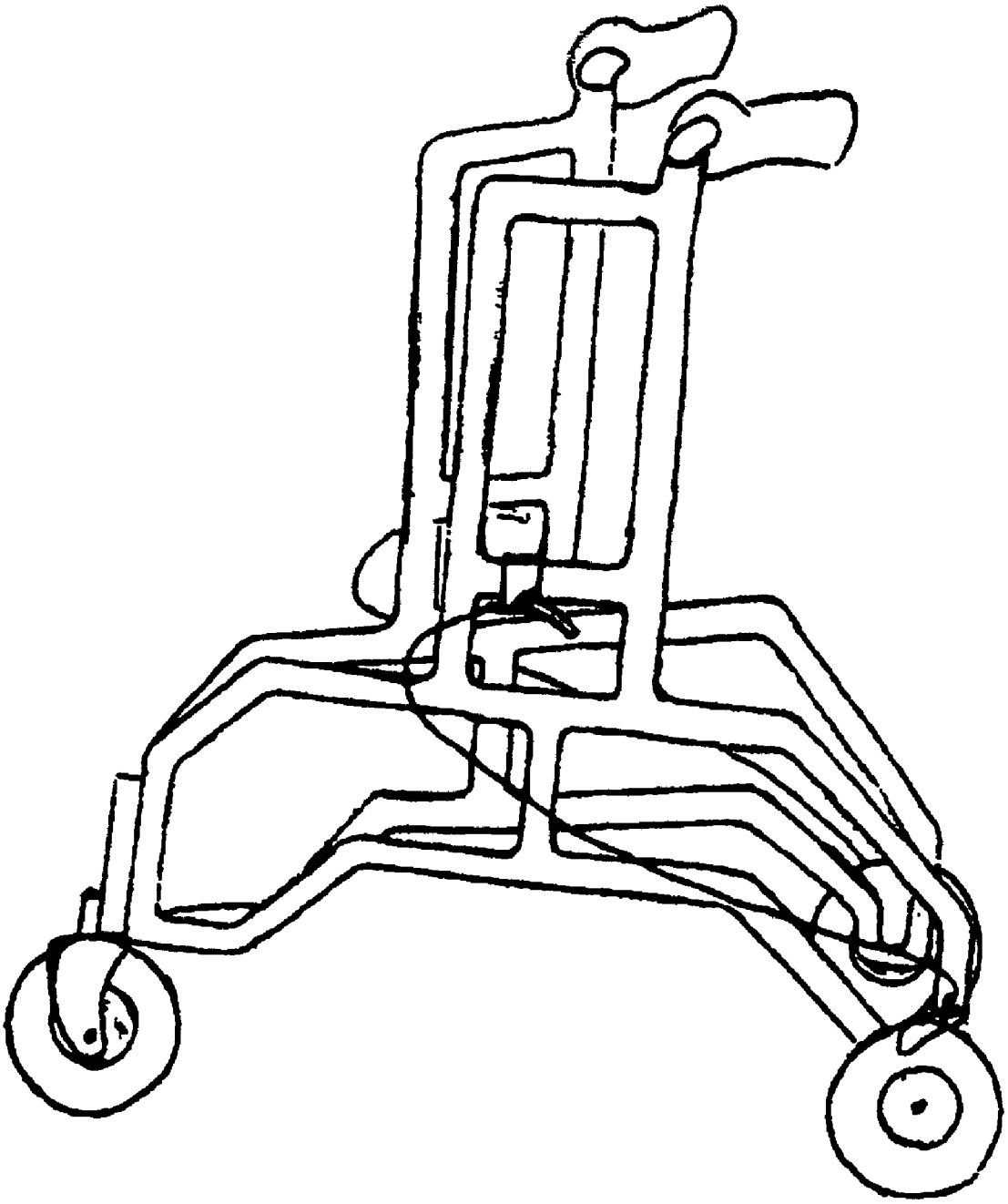
FIG. 5 shows a standing simplified version of the crutch stroller.
Figure 6:
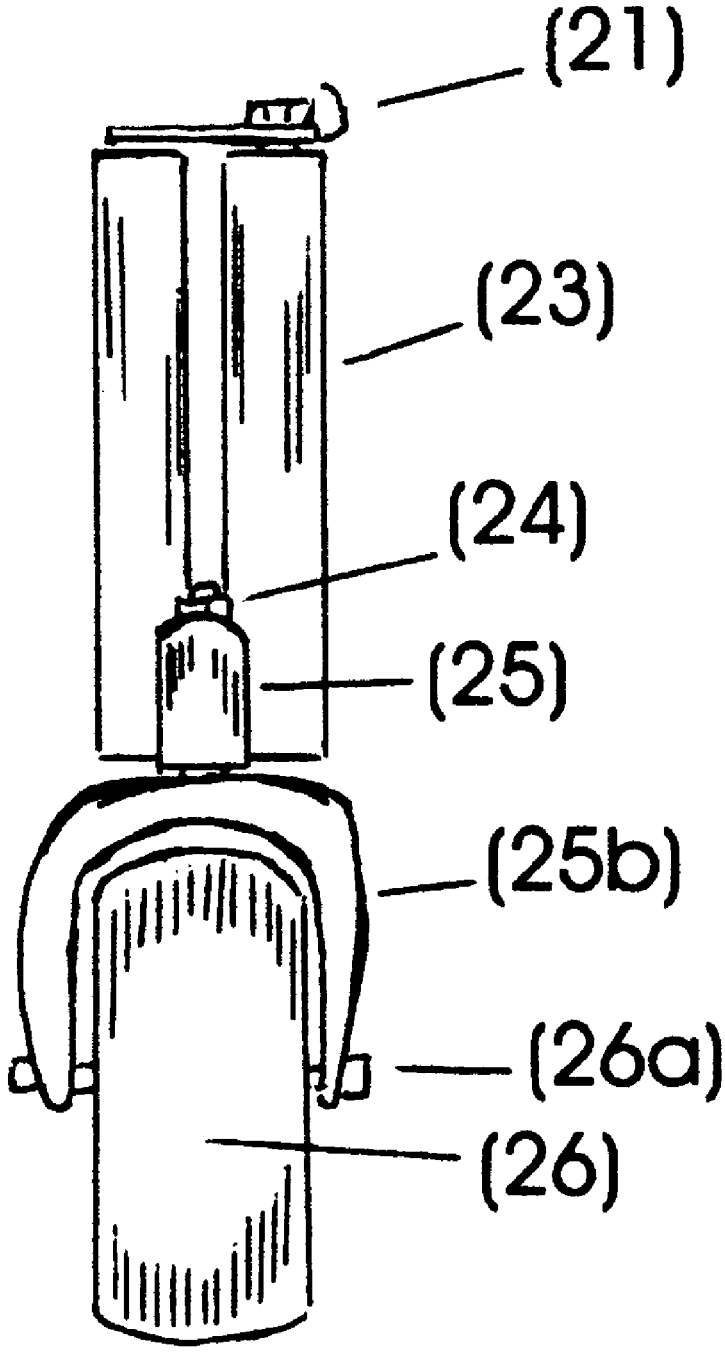
FIG. 6 shows a front view of the guide wheel assembly

FIG. 4 shows a simplified right sided perspective view of an individual user of the crutch stroller standing within the open entry space during operation of the device, FIG. 5 shows a plain left sided view of the crutch stroller, including each side of the main frame, FIG. 6 is a front perspective view of the front guide wheel (26), comprising a caster plate and bolt, bilateral vertical members (23), a caster bolt and caster (25), a swivel caster fork (25*b*), a front wheel axel (26*a*), and a seven and one inch front wheel (26).

Operation—FIGS. 1, 2, 3

The practical use of the crutch stroller is typically implemented by the determinations and order of a physician that are based on the capable strengths and weaknesses of a patient or individual to be a candidate for the prescribed use of a mobile device either in home, hospital, nursing facility, physical therapy unit, post operative orthopedic patients, or servicemen with impaired ambulatory skills due to injury.

Thereafter, usage is initiated with an individual standing within the "V" shaped open entry space as shown in FIGS. 2, and 4, so that each armpit rest comfortably upon bilateral arm pads 10*a*, as each arm is extended in a downward position with both hands resting on each riser connector 15*a*, which serves as the second support location. This position allows for three contact point-locations for support: the armpits, hands, and feet, that enable correct posture, reinforced support, steady gait during independent ambulation, and stability due to the envelopment of the body on both by a sturdy bilateral main frame 20, 17, 18, and 19 FIG. 1, and sturdy bilateral vertical risers 15, FIG. 1, to include sturdy support towers 12, 12*a*, and 13*a*, FIG. 1.

To operate this-present invention the individual user will ambulate independently step-by-step while weight is evenly distributed on both feet, during which time the weight on the legs and feet is minimized by the additional support of armpit pads 10*a*, and the placement of the hands on the riser connectors 15*a*. Plenty of foot room is allowed due to the elevation of the bilateral base members 22, 28, and 29. Steering is accomplished by upper body movement to the left or right resulting in the swivel caster 25, FIG. 1, 2, and 3 allowing the guide wheel 26, FIGS. 1, 2, and 3, to shift either left or right. Brakes are applied by squeezing the bilateral hand brake controls 16, FIG. 1, which results in a positive pressure on the rear wheels 30, FIG. 1.

Movement, turns, and stops are completely controlled by the patient or individual independently, while vertical adjustment in height of the support bars 12, 12*a*, 13, and 13*a* can be obtained the vertically lowering or raising the vertical supports bars 12, 12*a*, 13, and 13*a*, FIG. 1, as a unit and the placement of pins 14, into the pin holes 14*a* FIG. 1, for stability.

Advantages

Advantages of the crutch stroller include but is not limited-to-plenty of leg and foot room during ambulation due to the elevation of the bilateral base members 22, 28, and 29, two bilateral support bars 12, 12*a*, 13, and 13*a*, centered for reinforced center of gravity, a rigid adjustable open entry sturdy frame, easily transported due to the retraction of the support bars 12, 12*a*, 13, and 13*a*, into the open end risers 15, wheels large enough to accommodate ease of movement on ruff or smooth surfaces, requires little storage space, not limited in structural integrity when folded, and has stability and support with a reinforced base.

Additional Embodiments

There are various possibilities with regard to the construction. Since the present invention can be ordered according to the individual user's size, the construction material can be optional: meaning that the tubular construction can be formed either from aluminum or reinforced plastics.

Another alternative embodiment would be the use of an attachable basket for carrying small packages or necessities during ambulation that would rest on, and be attached to the front platform towers 17, FIG. 1, by means of Velcro straps.

Another alternative embodiment is a plastic padded seat that would rest on the rear platform towers 18, FIG. 1.

In this exemplary model of a combination walker and crutches, it is clearly a far more superior mobility aid than stand alone crutches, regular roll walkers, and any of the aforementioned prior art attempts at creating a device such as this present invention: for even though the stand alone crutch give support, they do not accommodate the user with a stable base, and regular roll walkers have a stable base; however the lack of support for the back, wrists does not relieve very much pressure from weak lower extremities, which will surely result in frequent periods of exhaustion and limited exercise.

The aforementioned prior art references all neglected to accomplish successfully the safety features of enhanced vertical support bars such as in the present invention, nor have they maintained a center of gravity for support bars that will avoid falls backwards during use. And without the features of support, stability, or ease of transport by private vehicle, use outside of a hospital, nursing home or institution would be limited. The present invention clearly has bilaterally enhanced double vertical support bars that are positioned for a safe center of gravity, stability and support with a stabilized base, a design for ease of transport by private vehicle without the task of disassembly of multiple parts, light weight, bilateral handbrakes and inexpensive to manufacture.

Conclusion, Ramifications, and Scope

In this present invention you find a novel design created with both physical and structural differences from prior art designs for a mobile aid device that combines both the stability of a walker and the support feature of crutches. Among the structural differences from prior art designs are the height elevation of the base members 22, 28, and 29, FIG. 1, that allows for unhindered leg and foot movement without stumbling over a low base member, and further presenting and enhanced elongated tubular main frame that is reinforced with substantially identical upper and lower members comprising 17, 18, 19, 20, 22, 28, and 29, FIG. 1.

Other structural differences are, found in the vertical support members 12, 12*a*, 13, and 13*a*, FIG. 1, that are constructed with bilaterally adjustable vertical support members; the handbrake design is bilaterally positioned to maintain a center of gravity operation; bilaterally double vertical risers 15, FIG. 1, are joined by connectors 15*a*, FIG. 1, to provide means for enhanced adjustable support members 12, 12*a*, 13, and 13*a* FIG. 1, by decreasing the length of all support members, whereby all support members are strengthened and maintain a safe center of gravity.

Physical differences include the ease of transport due to the folding bracket 35, FIG. 2, together with the adjustable support members 12, 12*a*, 13, and 13*a* will physically reduce the height and width of the present invention to allow ease of transport.

It is concluded, that this present invention having a fully foldable capability, a rigid but adjustable open entry frame, light weight sturdy members with the combining features of stability and support, to include safety and a novel design with controlled directional steering, guided easily by the individual user on carpet or ruff surfaces, and the benefit of being inexpensive to build and not limited in structural integrity when folded, and requiring little storage space at unused locations and upon transportation in private vehicles.

Although the description above contains much specificity, these should not be construed as limiting the scope of the invention, but as merely providing illustrations of some of the presently preferred embodiments of this invention.

I claim:

1. A crutch stroller, comprising: a wheeled walker having a main frame including a plurality of elongated cylindrical tubular members of varying lengths, consisting of rigid material selected from a group consisting of aluminum having sufficient durability for providing mobilized body support for an individual, said main frame comprising a two sided V-shape, contiguously jointed at the anterior junction of said main frame, each of said two sides of said main frame comprising weld joints, each of which joins a respective one of said two sides as a horizontally paralleling, upper and lower member with a open end rear entry defining a space in which said individual may stand during operation of said walker, said anterior junction comprising a pivotally mounted, bilaterally vertical reinforcing member disposed at said anterior junction, wherein anterior connection of each side of said main frame is weld jointed respectively to a corresponding side of said bilateral vertical member in order for said two sides of said main frame to be folded towards each other, a caster plate and bolt are mounted to upper ends of said bilateral vertical member to secure opposite sides of said vertical members, said horizontally paralleling upper main frame portion, comprising an ascending upper member converging bilaterally from said contiguously jointed anterior junction, and maintaining horizontal continuity for connection to a front platform member and rear platform member, between which a reinforced vertically enhanced crutch portion disposed on opposite sides of said main frame are mounted thereon, and including a plurality of vertical tubular support members, each of said crutch members being advantageously positioned For a sturdy center of gravity with sufficient height; an arm pad adhesively attached to said vertical support members provide underarm support to a user, said crutch members includes hand grip means mounted horizontally on said crutch members, said hand grip portion includes a hand brake mechanism attached, whereby applying braking force to said rear wheels is provided; a 45 degree rear descending member disposed on each side of said main frame provides an interconnecting rear base member, whereby a wheel engaging element with a brake connection and rear axel with rear wheel may be mounted thereon, horizontally paralleling lower members comprising a lower ascending member reinforcing said upper ascending member, a horizontally paralleling base member, by which reinforcement of said horizontally paralleling upper member is provided, a descending lower member, wherein reinforcement of said upper descending member completes a rear end closure of said wheel base, and said horizontally paralleling lower base member, which includes a plurality of sufficiently sized wheels mounted thereon with predetermined spacing, and further including a vertical member horizontally centered between said horizontally paralleling upper and lower members, whereby stability and reinforcement of said upper and lower horizontally paralleling members are provided.

2. The crutch stroller of claim 1, in which said side frame members may be folded towards each other include locking means which secure the two sides of said main frame in the unfolded position.

3. The crutch stroller of claim 2, wherein said side frame members may be folded includes a folding bracket pivotally mourned horizontally and disposed to the forward end of said front platform tower, each end of said folding bracket being disposed on opposite sides of said front platform towers and mounted thereon.

4. The crutch stroller of claim 1, wherein said brake mechanism is attached, comprises brake lever means, and at least one of said wheel engaging elements mounted on said side frame in braking relationship to a wheel, and means interconnecting said hand brake lever means and said wheel engaging element comprising a brake cable connector, whereby operation of said hand brake lever means produces braking of said wheel.

5. The crutch stroller of claim 4, further comprising a pair of wheel engaging elements mounted laterally on opposite sides of each said descending member and disposed adjacent each of Maid rear wheels.

6. The crutch stroller of claim 1, in which said crutch members are vertically reinforcing members, comprises front and rear vertical support members including at least a pair of telescoping interrelated front and rear members on opposite sides of said main frame, arranged so that two of said telescoping members of each said pair slides within a respective lower member of said pair, whereby said crutch members may be vertically adjustable relative to said horizontally paralleling upper members.

7. The crutch stroller of claim 6, further comprising locking means arranged on each of said lower telescoping member, to stop movement of each said pair of telescoping members.

8. The crutch stroller of claim 6, in which said front and rear vertical support members having upper ends, each of said upper ends being connected to a horizontal tubular connector with vertical ending on each of said ends, whereby each end of said horizontal connectors are mounted respectively to a corresponding upper end of said crutch members.

9. The crutch stroller of claim 8, wherein said horizontal tubular connectors having underarm support means mounted, comprising a L-shaped tubular member mourned on apposite sides of said upper ends of said crutch members, whereby at least one L-shaped member is disposed on opposite sides of said horizontal tubular connectors and disposed with a rear end connection to each of said horizontal tubular connectors.

10. The crutch stroller of claim 1, wherein a front guide wheel is pivotally mourned to the underside of said anterior junction, which includes a swivel caster assembly, said swivel caster includes a hollow cylinder enclosing a bearing and vertical caster bolt secured with a nut.

11. The crutch stroller of claim 10, further comprising a horizontal axle on which said front guide wheel is mounted thereon, and said swivel caster assembly further defining a space in which said wheel and said axle are interconnected respectively in order to change direction of said walker.

12. The crutch stroller of claim 1, wherein said rear wheel mounting comprises rear axles, jointed on opposite sides of said main frame, and disposed laterally on lower descending members and secured with lock nuts.

13. The crutch stroller, comprising an enhanced wheeled walker having a "V" shaped, pivotally mounted foldable two sided main frame with reinforced horizontally paralleling, upper and lower members, consisting of sufficiently durable rigid material for body support with a rear end open entry, a pair of advantageously reinforced vertical crutch members telescopically adjustable and mounted on each side of said upper horizontally paralleling members, and selectively positioned for a sturdy center of gravity, and including means for locking said telescoping members for different vertical positions, underarm pads attached to upper ends of said crutch members, with band grips and braking means mounted on said vertical crutch members, horizontally paralleling lower members provide a stable wheel base, wherein the rear portion of said wheel base provide mounts for fixed axles with rear wheels disposed thereon, and a front guide wheel being pivotally mounted within a swivel caster assembly disposed beneath an anterior junction in which said two sides of said main frame are joined.

* * * * *